US012678648B2

(12) United States Patent
Chen

(10) Patent No.: US 12,678,648 B2
(45) Date of Patent: Jul. 14, 2026

(54) TRAMPOLINE ATTACHMENT HANDLE

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 114 days.

(21) Appl. No.: 18/774,664

(22) Filed: Jul. 16, 2024

(65) Prior Publication Data

US 2026/0021333 A1 Jan. 22, 2026

(51) Int. Cl.
*A63B 5/11* (2006.01)
*A63B 21/00* (2006.01)

(52) U.S. Cl.
CPC ..... *A63B 5/11* (2013.01); *A63B 21/4035* (2015.10)

(58) Field of Classification Search
CPC ... A63B 5/11; A63B 21/4035; A63B 22/0046; A63B 26/00; A63B 26/003; A63B 71/0054; Y10T 403/1649; F16B 7/0433
USPC ..... 16/110.1–446, 900–906; 403/17
See application file for complete search history.

(56) References Cited

U.S. PATENT DOCUMENTS 950,444 A * 2/1910 Goeke ..... A47J 36/08 294/34
2,914,785 A * 12/1959 Chipman ..... A46B 5/02 16/DIG. 12
5,797,166 A * 8/1998 Wagenheim ..... A47G 25/1457 16/443
6,360,402 B1 * 3/2002 Crabtree ..... A45C 13/00 16/431
9,776,030 B1 * 10/2017 Louis ..... A63B 5/11
10,940,353 B2 * 3/2021 Fischer ..... F16B 2/065
D1,034,152 S * 7/2024 Liu ..... D8/349
2020/0338379 A1 * 10/2020 Chen ..... A63B 5/11
2020/0368597 A1 * 11/2020 Colling ..... A63B 5/11
2023/0414985 A1 * 12/2023 Male ..... A63B 71/023

FOREIGN PATENT DOCUMENTS

DE 202023103097 U1 * 6/2023 ..... A63B 5/11
KR 102146074 B1 * 8/2020 ..... A63B 71/0622

* cited by examiner

*Primary Examiner* — Gary D Urbiel Goldner
(74) *Attorney, Agent, or Firm* — Clement Cheng

(57) ABSTRACT

A trampoline attachment handle has a retainer extension. The retainer extension has a retainer extension inside end and a retainer extension outside end. A ring connector is connected at the retainer extension inside end. A handle is formed on the retainer extension outside end. A frame connector is connected at the retainer extension outside end. The trampoline attachment handle comprises a first handle section and a second handle section. The first handle section connects to the second handle section at a resilient section. The trampoline attachment handle has a frame connector formed as a frame connector socket, shaped to receive a horizontal frame member of a trampoline.

12 Claims, 12 Drawing Sheets

TRAMPOLINE ATTACHMENT HANDLE

TECHNICAL FIELD

The present invention is in the field of trampolines.

BACKGROUND

A variety of different trampolines have handle attachments that provide stability for users using a trampoline. For example, in U.S. Pat. No. 10,940,353, entitled Trampoline, states, "A trampoline includes a stand which has a peripheral frame, a plurality of legs and a bounce mat which is elastically suspended on the frame. At least one guide is secured to the stand. A bar is received in a height adjustable manner in the guide. An inner piece is movably received in the guide. The bar is fixed by a relative movement between the inner piece and the guide."

For example, in U.S. Pat. No. 9,776,030, entitled Rebound And Balance Training Device, states, "A rebound and balance training device includes a frame, a footboard, and a plurality of resilient spring elements extending between and attached to the frame and the footboard to support the footboard above a supporting surface. A user standing on the footboard manually effects repeated vertical bouncing movement between upper and lower positions. The distance traveled by the footboard, the effort required to effect movement, and the stability thereof may be modified by selectively modifying the number, the length, the position, or the elasticity of the resilient elements. In one embodiment, a pair of footboards is employed to simulate skiing movements."

For example, in United States patent publication, 2020/0368597, entitled Attachable goal, states, "A goal that is configured to connect to a frame of a trampoline. The goal includes tube clamps, support tubes, pivoting brackets, and multiple bars that support a netting. The tube clamps are rotatable around the poles to which they are attached, and the pivoting brackets can pivot around the connection point with the support tubes."

SUMMARY OF THE INVENTION

A trampoline attachment handle has a retainer extension. The retainer extension has a retainer extension inside end and a retainer extension outside end. A ring connector is connected at the retainer extension outside end. A handle is formed on the retainer extension outside end. A frame connector is connected at the outside end. The trampoline attachment handle of claim 1 comprises of a first handle section and a second handle section. The first handle section connects to the second handle section at a resilient section. The frame connector formed as a frame connector socket is optionally shaped to receive a horizontal frame member of a trampoline. The frame connector socket has a frame connector hook section extending to a frame connector hook tip. The retainer extension has a retainer extension right edge and a retainer extension left edge. The retainer extension is a flat elongated member. The ring connector has a ring hook notch. The ring connector has a ring connector right hook and a ring connector left hook. The ring connector has a ring connector right tip and a ring connector left tip. Thus, the present invention allows attachment of a trampoline attachment handle to an existing trampoline at a trampoline frame and spring ring.

The following call out list of elements can be a useful guide in referencing the element numbers of the drawings.

18 Attachment Handle
20 Retainer Extension
21 Retainer Extension Right Edge
22 Retainer Extension Left Edge
23 Retainer Extension Inside End
24 Retainer Extension Outside
30 Ring Connector
31 Ring Connector Right Tip
32 Ring Connector Left Tip
33 Ring Connector Right Hook
34 Ring Connector Left Hook
35 Ring Hook Notch
40 Frame Connector
41 Frame Connector Hook Section
42 Frame Connector Socket
43 Frame Connector Hook
50 Handle
51 First Handle Section
52 Second Handle Section
53 Handle Loop
54 Resilient Section
55 Second Handle Connection
56 First Handle Connection
60 Handle Attachment Pair
61 Right Attachment Handle
62 Left Attachment Handle
71 Frame
72 Spring
73 Connection Ring
74 Bed Hem
75 Bed
76 Frame Leg
81 Strap Retainer
82 Threaded Receiver
83 Threaded Barrel
84 Handle Front Connection
85 Handle Rear Connection
86 Cinch Buckle
87 Spring Frame Connection
88 Handle Strap
89 Connector Link
91 Right Loop Connector
92 Left Loop Connector
93 Right Loop
94 Left Loop
101 First Ring
102 Second Ring
103 First Handle Cover Grip
104 Second Handle Cover Grip
105 Spring Cover

DETAILED DESCRIPTION OF THE EMBODIMENTS

Figure 1:
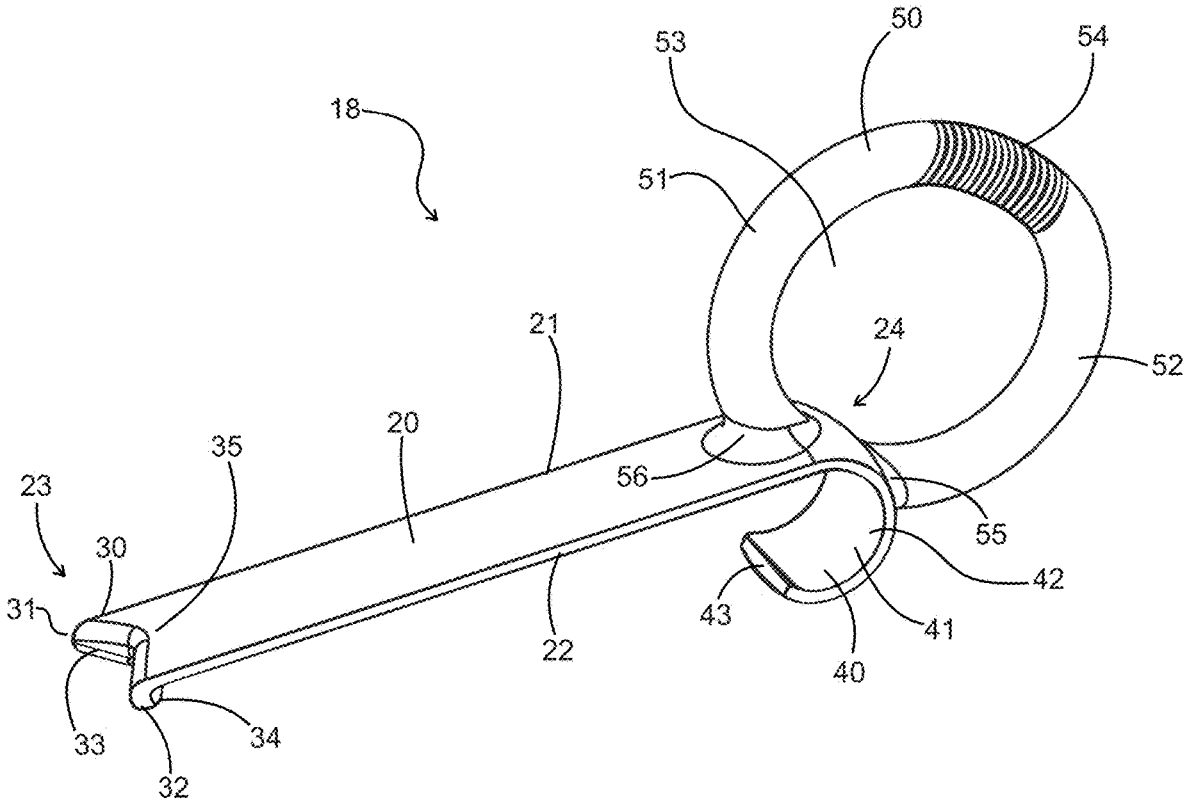
FIG. 1 is a perspective view of the present invention's first embodiment.

As seen in FIG. 1, the attachment handle 18 has a handle portion 50, a retainer extension 20 and a ring connector 30. The handle 50 connects to the retainer extension 20. The retainer extension 20 has a retainer extension inside end 23 and a retainer extension outside end 24. The handle 50 has a handle loop 53 where a first handle section 51 loops around to connect to a second panel section 52. The first handle section 51 can be connected to the second panel section 52 at a resilient section 54. The resilient section 54 can have a helical spring that connects to the inside portion of the hollow tubular first handle section 51 and the second handle section 52. The helical spring of the resilient section 54 could be covered by a plastic corrugated helical spring cover. A person falling and landing on the first handle section 51 may be protected from injury if the first handle section 51 is made of an elastomeric material such as a high density polyethylene material that is flexible.

The retainer extension 20 extends between the ring connector 30 and the handle 50. The retainer extension 20 can be a flat resilient member. The retainer extension inside end 23 has a ring connector 30. The ring connector 30 preferably connects to a ring by hooking to it. For connecting to a triangular ring, preferably a ring connector right tip 31 and a ring connector left tip 32 can hook with a ring connector right hook 33 and a ring connector left hook 34. A ring connector hook notch 35 forms a part of the ring connection. The right hook portion and the left hook portion can join in the middle. The retainer extension 20 can be formed as a flat elongated member with a retainer extension right edge 21 and a retainer extension left edge 22.

The handle 50 is formed at the retainer extension outside end 24. The retainer extension outside end also has a frame connector socket 42 which attaches to a horizontal tubular member of the trampoline frame. The frame connector hook tip 43 extends underneath a horizontal tubular member of the trampoline frame and can clamp to the horizontal tubular trampoline frame. The frame connector 40 has a frame connector hook section 41 that forms a frame connector socket 42. The frame connector socket 42 is transverse and parallel to the retainer extension 20. The frame connector socket 42 also has a second handle section 52 extending from it upwardly to the first handle section 51. The resilient section 54 may have a grip covering it for improved grip strength. A user landing on the first handle section 51 would bias the ring connector 30 away from the mat. The frame connector socket 42 may rotate relative to the horizontal tubular member of the trampoline frame.

Figure 2:
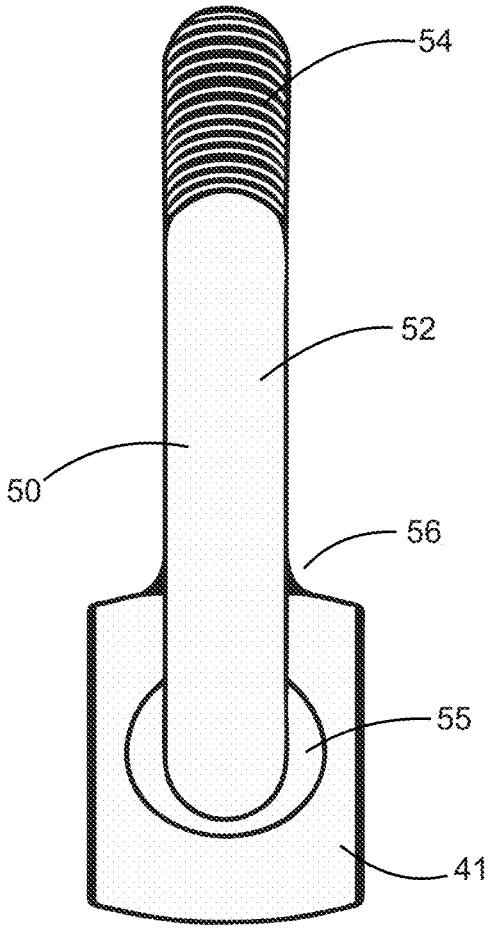
FIG. 2 is a rear view of the first embodiment.

As seen in FIG. 2, the attachment handle 18 has a resilient section 54 connected to a second handle section. The first handle connection 56 connects the front portion of the first handle section to the frame connector hook section 41, and the second handle connection 55 connects the rear portion of the second handle section 52 to the frame connector hook section 41.

Figure 3:
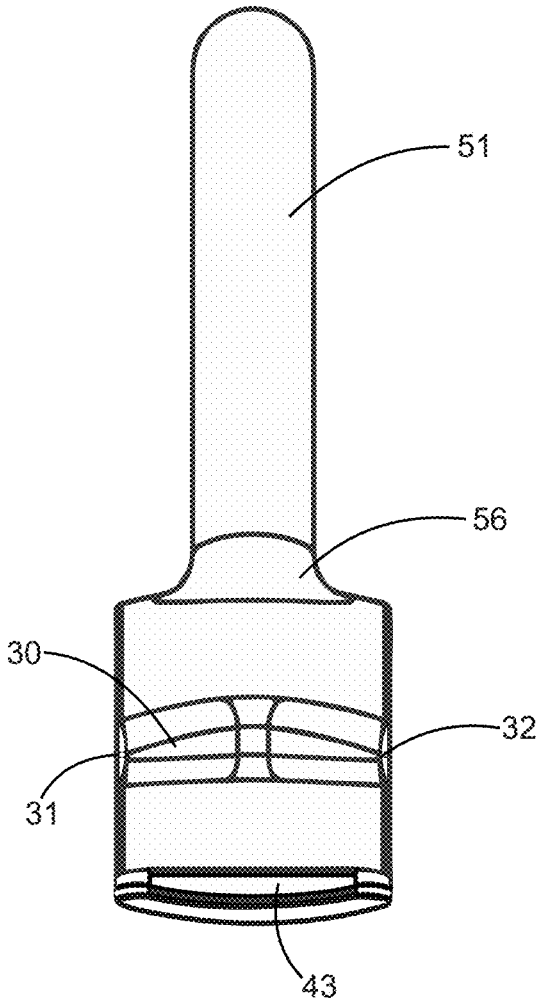
FIG. 3 is a front view of the first embodiment.
Figure 4:
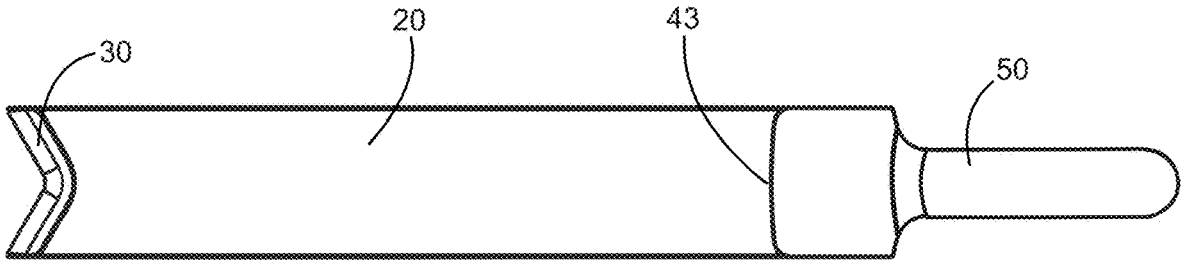
FIG. 4 is a bottom view of the first embodiment.
Figure 5:
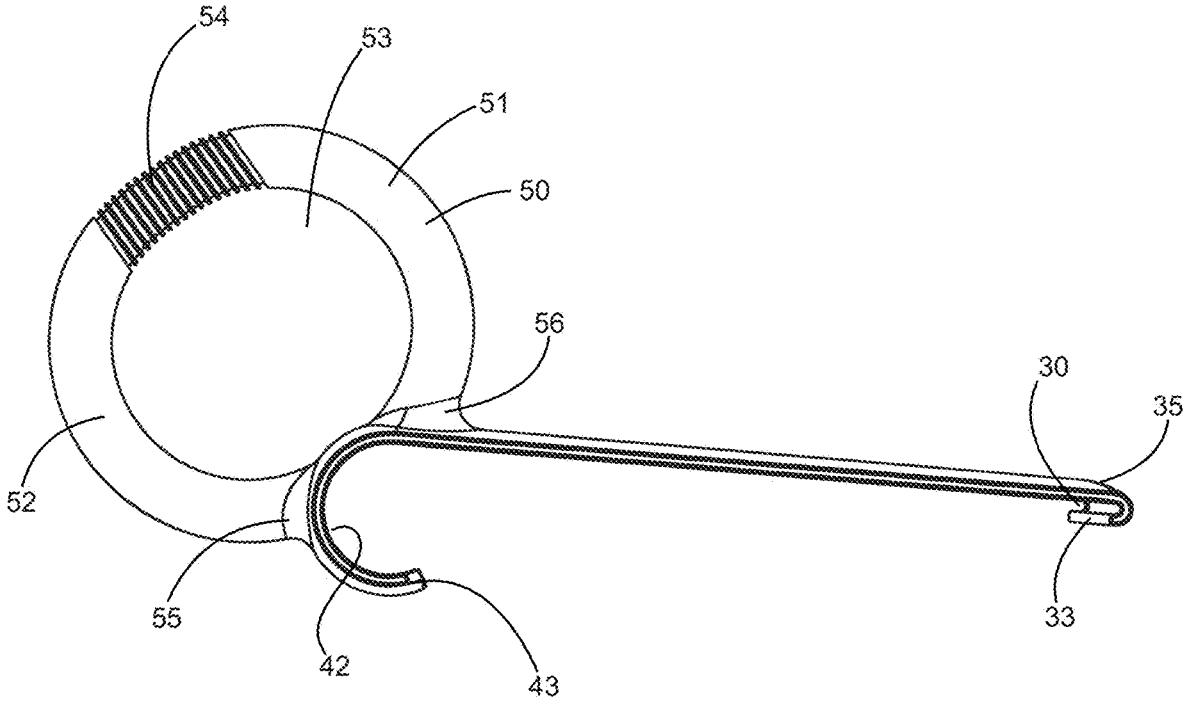
FIG. 5 is a side view of the first embodiment.

As seen in FIGS. 3-5, the view from the middle of the bed shows that the connector has a handle that is greater than the height of the frame connector hook section 41. The handle is approximately twice the height of the frame connector hook section 41. The portion of the handle 50, such as the first handle section 51 and the second handle section 52 provide a handle grip for user to improve balancing when exiting and entering a trampoline.

Figure 6:
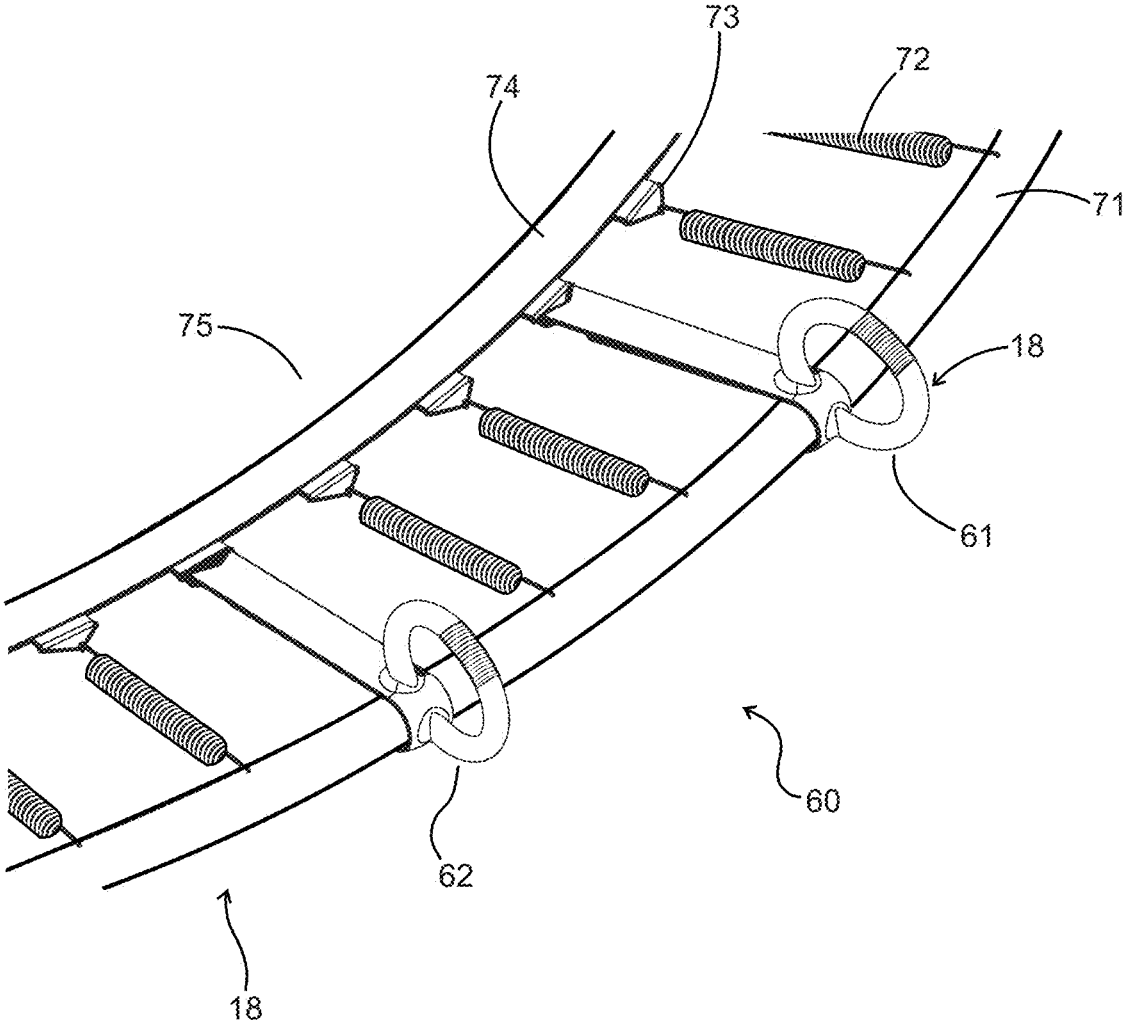
FIG. 6 is a perspective view of an installation.

As seen in FIG. 6, the bed 75 where the user jumps has a bed hem 74. The bed hem connects to a connection ring 73. The connection ring 73 connects to a spring 72. The spring connects to a frame 71. The attachment handle 18 is preferably deployed in pairs. The frame 71 receives a handle attachment pair including a right attachment handle 61 and a left attachment handle 62.

Figure 7:
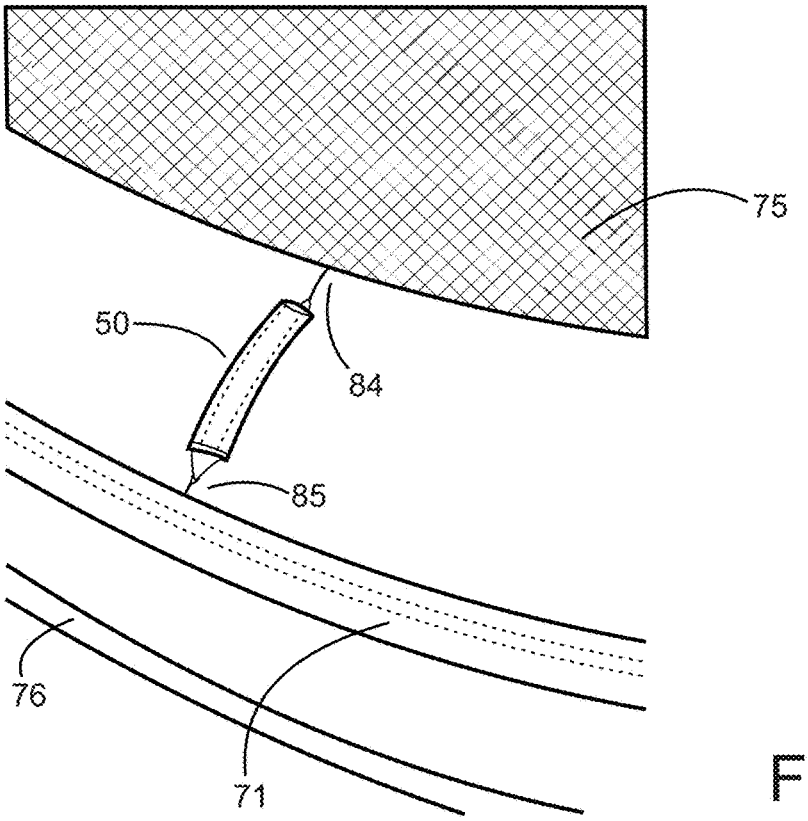
FIG. 7 is a perspective view of the second embodiment.
Figure 8:
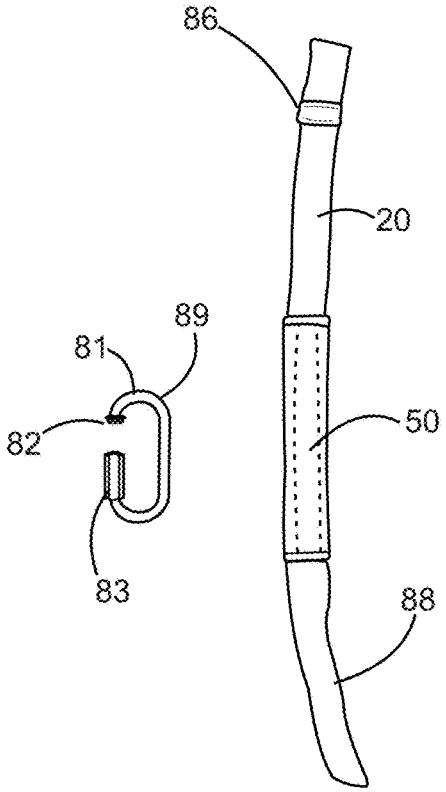
FIG. 8 is an exploded view of the second embodiment.
Figure 9:
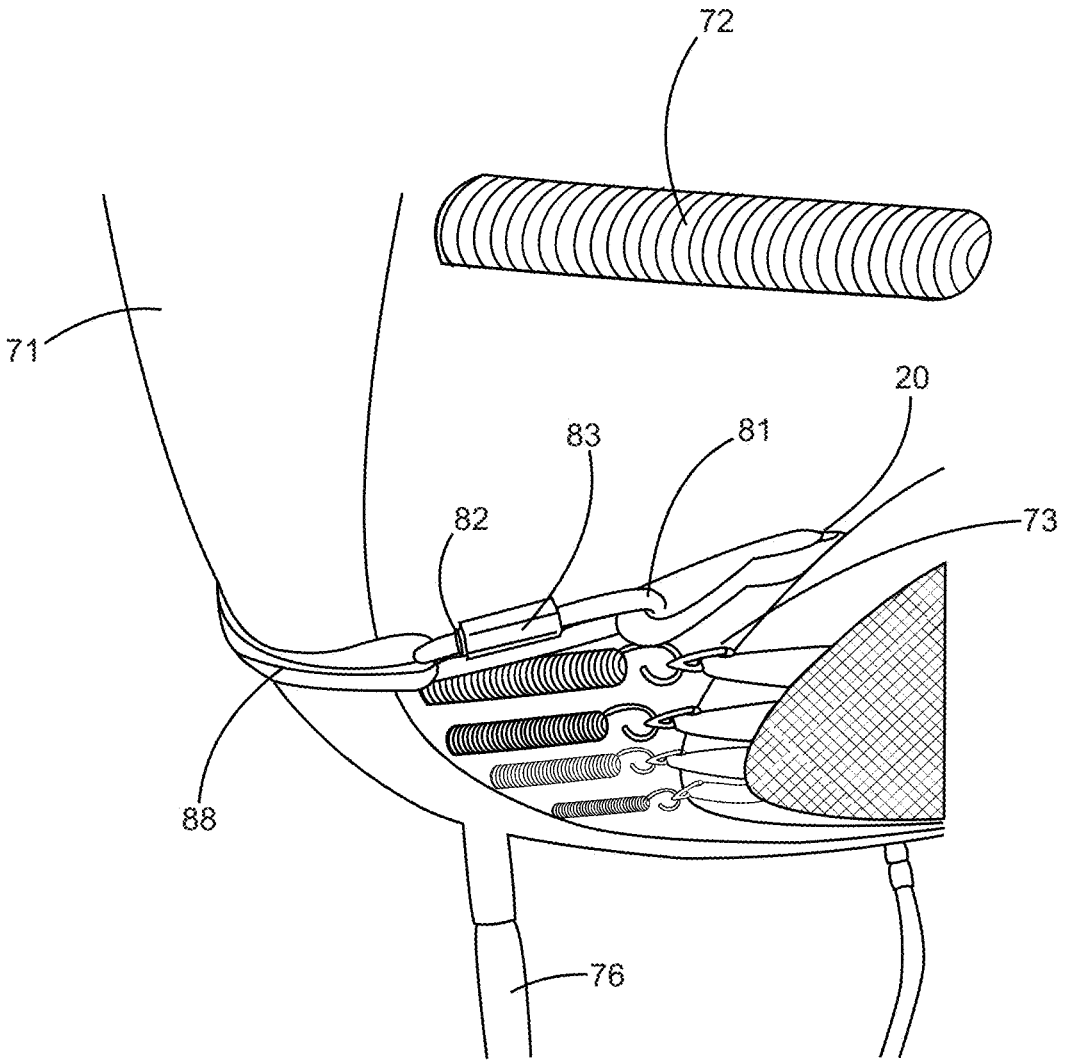
FIG. 9 is a bottom view of the second embodiment.

As seen in FIGS. 7-9, the bed 75 is stretched with springs across the frame 71. As seen in FIG. 7, the frame is supported at frame legs 76. Handle 50 is formed as a strap which has a handle front connection 84 to the connection ring 73 and handle rear connection 85 that fits over the frame 71 and connects to a connector link 89. The connector link 89 can join the strap retainer 81 and the handle strap 88 underneath the springs and the underneath the spring cover. As seen in FIG. 8, the handle 50 has components laid out with a retainer extension 20, a handle strap 88, and a cinch buckle 86 that cinches the retainer extension 20. A connector link 89 operates as a strap retainer 81 and can be locked with a threaded barrel 83 threading to a threaded receiver 82. As seen in FIG. 9, the friend leg 76 supports the frame 71. Looking from an underside of the frame 71, the strap retainer 81 connects to the handle strap 88 with the connection link that locks when the threaded receiver 82 threats to the threaded barrel 83. The strap retainer 81 retains the retainer extension 20 such that the retainer extension 20 makes a handle front connection 84 to the connection ring 73. The connection ring 73 has an opening that the retainer extension 20 can pass through before connecting to the strap retainer 81. The cinch buckle 86 or the strap retainer 81 can rotate to abut the connection ring 73 to prevent further rotation.

Figure 10:
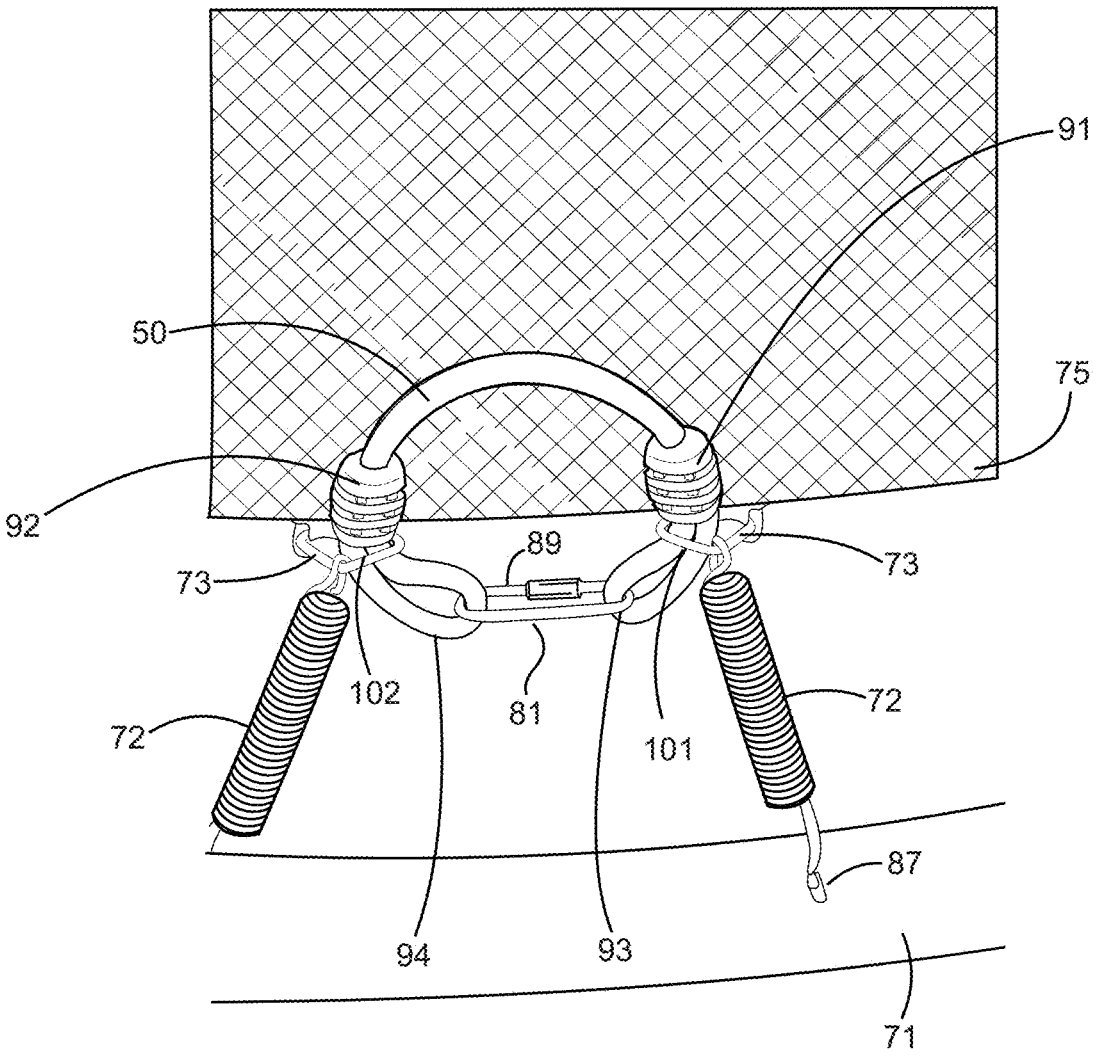
FIG. 10 is a diagram showing installation of the third embodiment.
Figure 11:
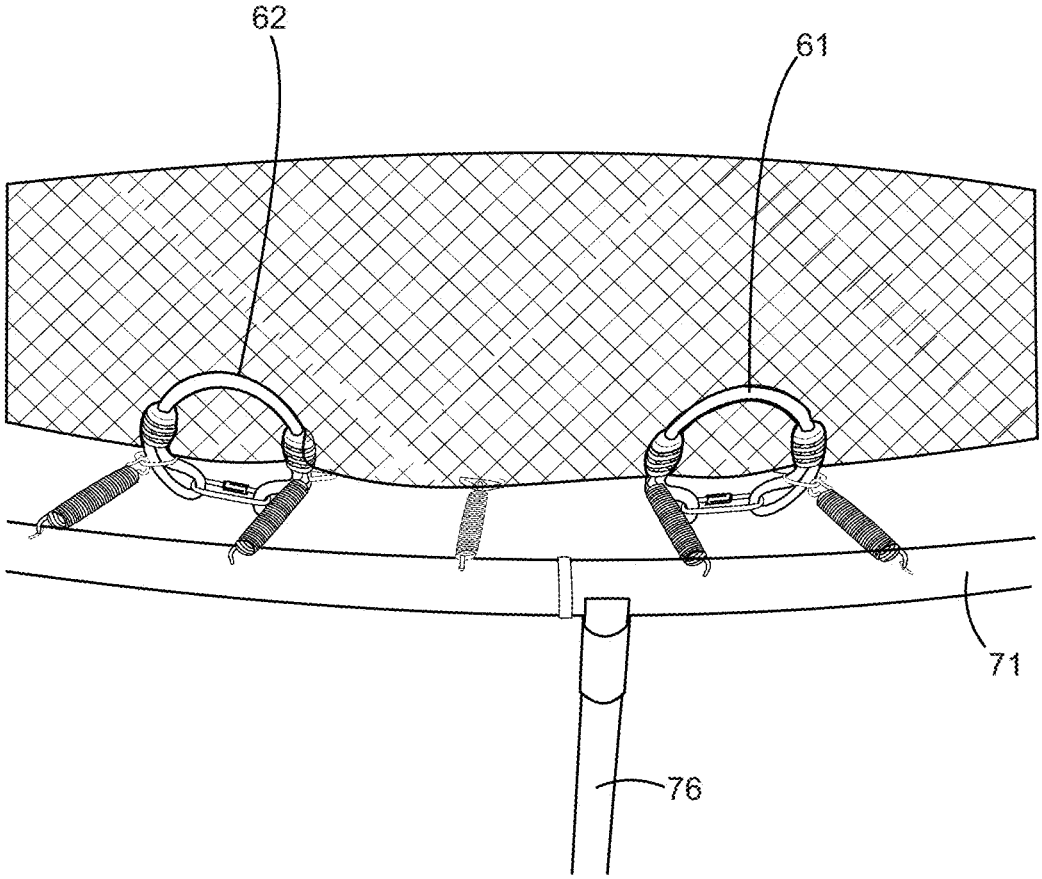
FIG. 11 shows a diagram with the left and right attachment handles.
Figure 12:
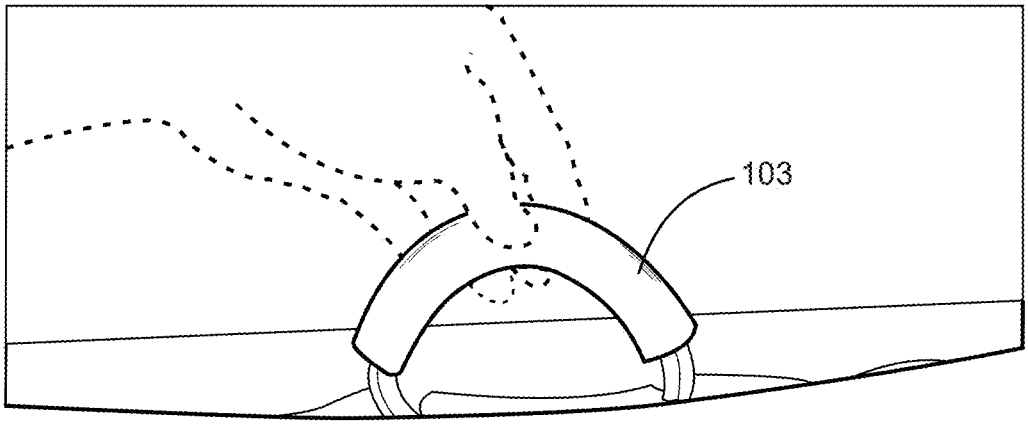
FIG. 12 shows the handle cover grips attaching to the left and right attachment handles.
Figure 13:
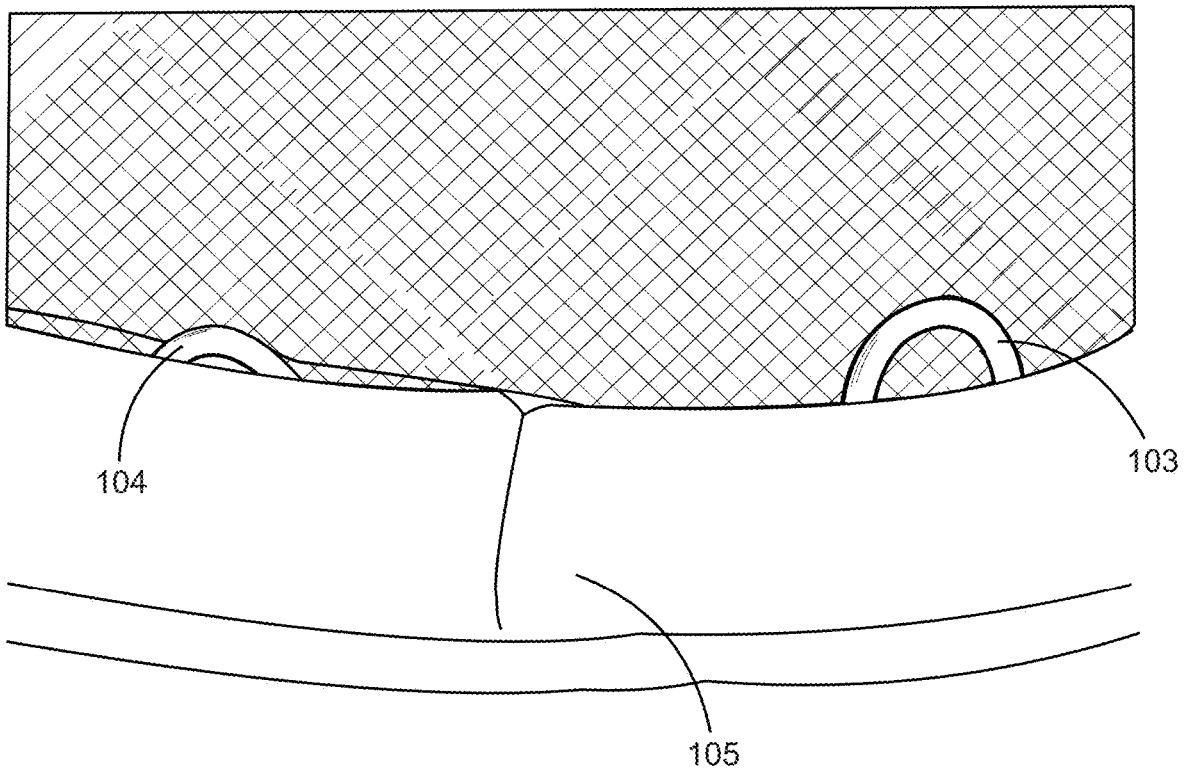
FIG. 13 shows the handle cover grips fitting over the left and right attachment handles.

As seen in FIGS. 10-13, the handle can also be mounted across and between connection rings 73. For example, as seen in FIG. 10 a first ring 101 can receive a right loop 93, and a second ring 102 can receive a left loop 94. The right loop connector 91 binds the right loop 93 and the left loop connector 92 binds the left loop 94. The bed 75 connects to the connection rings 73 including the first ring 101 and the second ring 102. The user jumps on the bed 75. After the handle is installed to the first and second rings, the springs 72 are covered by a spring cover which covers the spring frame connection 87 where the spring 72 connects to the frame 71. The spring cover is sometimes called a trampoline pad and can be a padded mat made of a foam layer encapsulated in plastic fabric. As seen in FIG. 11, a right attachment handle 61 can be connected to the first set of springs and the left attachment handle 62 can also be connected to a second set of springs. As seen in FIG. 12, a first handle cover grip 103 can be mounted over the handle strap to provide a more solid grip. The first handle cover grip can be a soft tubular member. A first handle cover grip 103 and the second handle cover grip 104 can fit over the first and second handles. In addition to the spring cover 105, the user can step over the trampoline periphery with confidence.

The invention claimed is:

1. A trampoline attachment handle comprising:

a. a retainer extension, wherein the retainer extension has a retainer extension inside end, a retainer extension outside end, and a non-adjustable length;

b. a ring connector, wherein the ring connector is connected at the retainer extension inside end;

c. a handle, wherein the handle is formed on the retainer extension outside end; and d. a frame connector, wherein the frame connector is connected at the retainer extension outside end;

wherein the frame connector is formed as a frame connector socket, wherein the frame connector socket is shaped to receive a horizontal frame member of a trampoline, wherein the frame connector socket has a frame connector hook section extending to a frame connector hook tip.

2. The trampoline attachment handle of claim 1, further comprising: a first handle section and a second handle section, wherein the first handle section connects to the second handle section at a resilient section.

3. The trampoline attachment handle of claim 1, wherein the retainer extension has a retainer extension right edge and a retainer extension left edge, wherein the retainer extension is a flat elongated member.

4. The trampoline attachment handle of claim 1, wherein the ring connector has a ring hook notch.

5. The trampoline attachment handle of claim 1, wherein the ring connector has a ring connector right hook and a ring connector left hook.

6. The trampoline attachment handle of claim 1, wherein the ring connector has a ring connector right tip and a ring connector left tip.

7. The trampoline attachment handle of claim 1, wherein the retainer extension has a retainer extension right edge and a retainer extension left edge, wherein the retainer extension is a flat elongated member, wherein the ring connector has a ring hook notch.

8. The trampoline attachment handle of claim 1, wherein the ring connector has a ring hook notch, wherein the ring connector has a ring connector right hook and a ring connector left hook.

9. The trampoline attachment handle of claim 1, wherein the ring connector has a ring connector right hook and a ring connector left hook, wherein the ring connector has a ring connector right tip and a ring connector left tip.

10. The trampoline attachment handle of claim 1, further comprising: a first handle section and a second handle section, wherein the first handle section connects to the second handle section at a resilient section, wherein the retainer extension has a retainer extension right edge and a retainer extension left edge, wherein the retainer extension is a flat elongated member.

11. The trampoline attachment handle of claim 1, wherein the ring connector has a ring hook notch, wherein the ring connector has a ring connector right hook and a ring connector left hook, wherein the ring connector has a ring connector right tip and a ring connector left tip.

12. The trampoline attachment handle of claim 1, further comprising: a first handle section and a second handle section, wherein the first handle section connects to the second handle section at a resilient section, wherein the retainer extension has a retainer extension right edge and a retainer extension left edge, wherein the retainer extension is a flat elongated member, wherein the ring connector has a ring hook notch, wherein the ring connector has a ring connector right hook and a ring connector left hook, wherein the ring connector has a ring connector right tip and a ring connector left tip.

* * * * *